United States Patent [19]

Stahl

[11] 4,201,130

[45] May 6, 1980

[54] FLUID-OPERATED PRESS

[75] Inventor: Alfred R. Stahl, Chapala-Jocotepec, Mexico

[73] Assignee: Michael P. Breston, Houston, Tex.; a part interest

[21] Appl. No.: 24,217

[22] Filed: Mar. 26, 1979

[51] Int. Cl.[2] ..... B30B 1/08

[52] U.S. Cl. ..... 100/271; 83/590; 83/633; 100/231; 100/257; 100/266

[58] Field of Search ..... 100/231, 266, 269 R, 100/270, 271, 272, 257, 280, 283; 83/590, 633, 634

[56] References Cited

U.S. PATENT DOCUMENTS

| | | | |
|---|---|---|---|
| 1,150,484 | 8/1915 | Bechman | 100/283 X |
| 3,004,458 | 10/1961 | Dvorak | 100/266 X |
| 3,044,450 | 7/1962 | Robinson | 100/271 X |
| 3,273,491 | 9/1966 | Calvert | 100/270 X |
| 4,092,005 | 5/1978 | Benroth | 83/633 |

FOREIGN PATENT DOCUMENTS

| | | | |
|---|---|---|---|
| 2114248 | 3/1971 | Fed. Rep. of Germany | 83/633 |

*Primary Examiner*—Billy J. Wilhite

*Attorney, Agent, or Firm*—Michael P. Breston

[57] ABSTRACT

The fluid-pressure actuated press is mounted on a column structure. It has a ram, a piston, and an associated piston rod. The free end of the piston rod reciprocates downwardly. A support adjustably mounts the ram on the column structure. A lever bar has a proximate free end in engagement with the free end of the piston rod. The distal end of the lever bar is pivoted about a fixed fulcrum carried by the support. A chuck rod is slidably mounted relative to the support along an axis which is parallel to the axis of the piston rod. The chuck rod is pivotably associated with the lever bar at a point intermediate its ends, whereby the reciprocation force on the piston rod is multiplied by the lever ratio to cause reciprocation of the chuck rod with the multiplied force.

3 Claims, 8 Drawing Figures

FIG. 1.
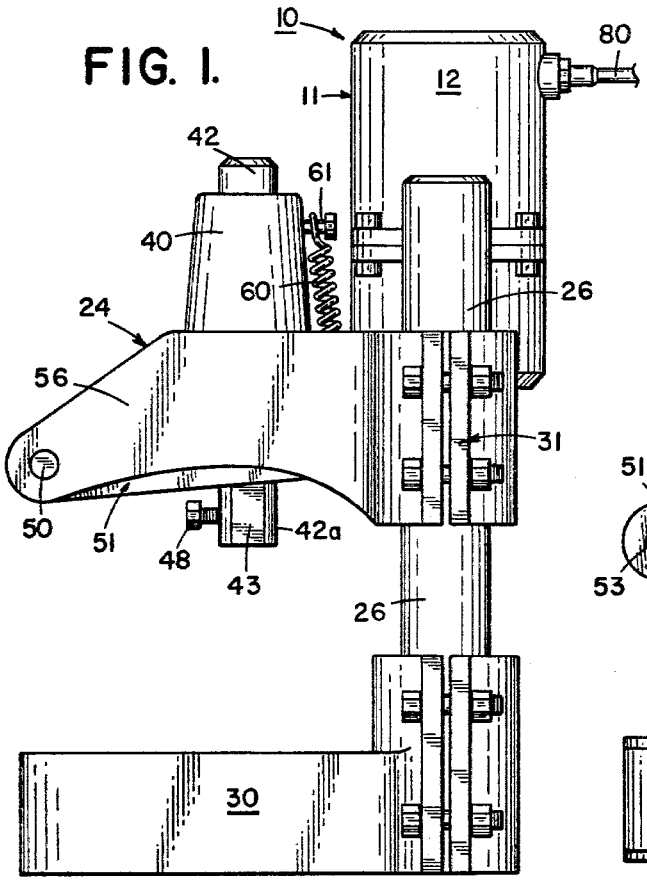
FIG. 7.
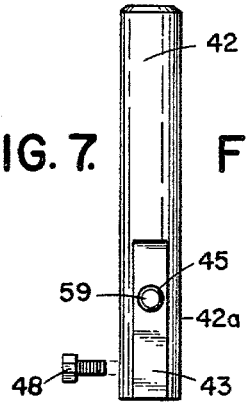
FIG. 8.
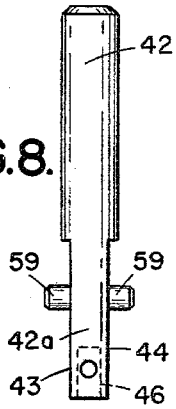
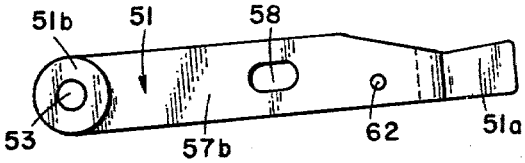
FIG. 5.
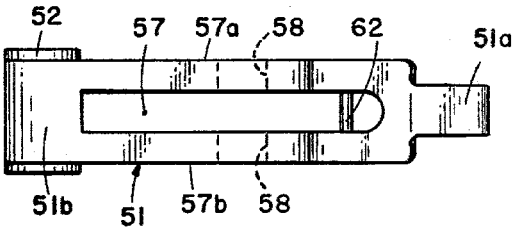
FIG. 6.
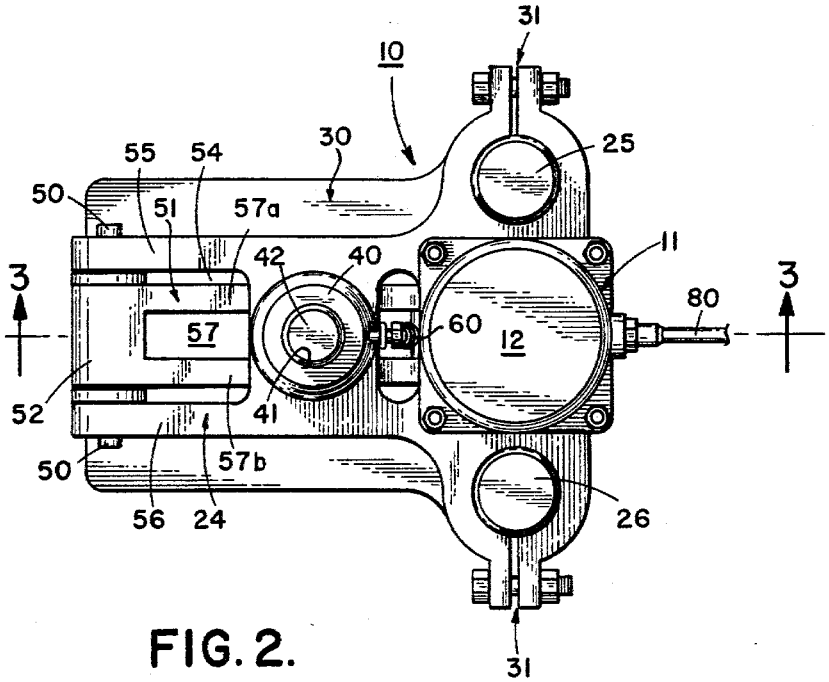
FIG. 2.

FLUID-OPERATED PRESS

BACKGROUND OF THE INVENTION (a) Field of the Invention

This invention relates to fluid operated column presses using pneumatic rams, either single-acting or double-acting.

(b) Description of the Prior Art

Air-operated column presses are known and can be advantageously used for many industrial applications. They have an advantage over mechanical presses in that the speed of operation is easily adjustable by regulating the volume of air admitted into the air cylinder and the working force of the piston rod is easily adjustable by regulating the pressure of the volume of air admitted into the air cylinder.

It is an object of this invention to improve on such known air-operated column presses by combining such presses with a novel lever arrangement to thereby multiply the force exerted by the piston rod by a desired lever ratio. In this manner, relatively small presses can exert large forces. The press provides economy of operation, occupies less space, and requires smaller air compressors.

It is another object of the invention to provide an air-operated press having a novel lever force multiplier arrangement and an air cylinder mounted relative to the column support so that no bending torque is exerted on the column by the reciprocating piston rod.

SUMMARY OF THE INVENTION

The fluid-pressure actuated press is mounted on the column structure. It has a ram, a piston, and an associated piston rod. The free end of the piston rod reciprocates downwardly with its longitudinal axis parallel to the axis of the column structure. A support adjustably mounts the ram on the column structure relative to a base. A lever bar has a proximate free end in engagement with the free end of the piston rod. The distal end of the lever bar is pivoted about a fixed fulcrum carried by the support. A chuck rod is slidably mounted relative to the support along an axis which is parallel to the axis of the piston rod. The chuck rod is pivotably associated with the lever bar at a point intermediate its ends whereby the reciprocation of the piston rod will cause reciprocation of the chuck rod but with a force multiplied by the lever ratio. Preferably two-spaced apart parallel columns are employed and the piston rod reciprocates therebetween.

BRIEF DESCRIPTION OF THE DRAWINGS

FIG. 1 is a side view in elevation of a preferred embodiment of the press;

FIG. 2 is a top view of the press shown in FIG. 1;

FIG. 5 is a front view of the lever bar shown in FIG. 3;

FIG. 6 is a top view of the lever bar;

FIG. 7 is a front view in elevation of a chuck rod adapted to extend through the longitudinal slot in the lever bar; and FIG. 8 is a side elevational view of the chuck rod shown in FIG. 7.

DETAILED DESCRIPTION OF A PREFERRED EMBODIMENT

Figure 4:
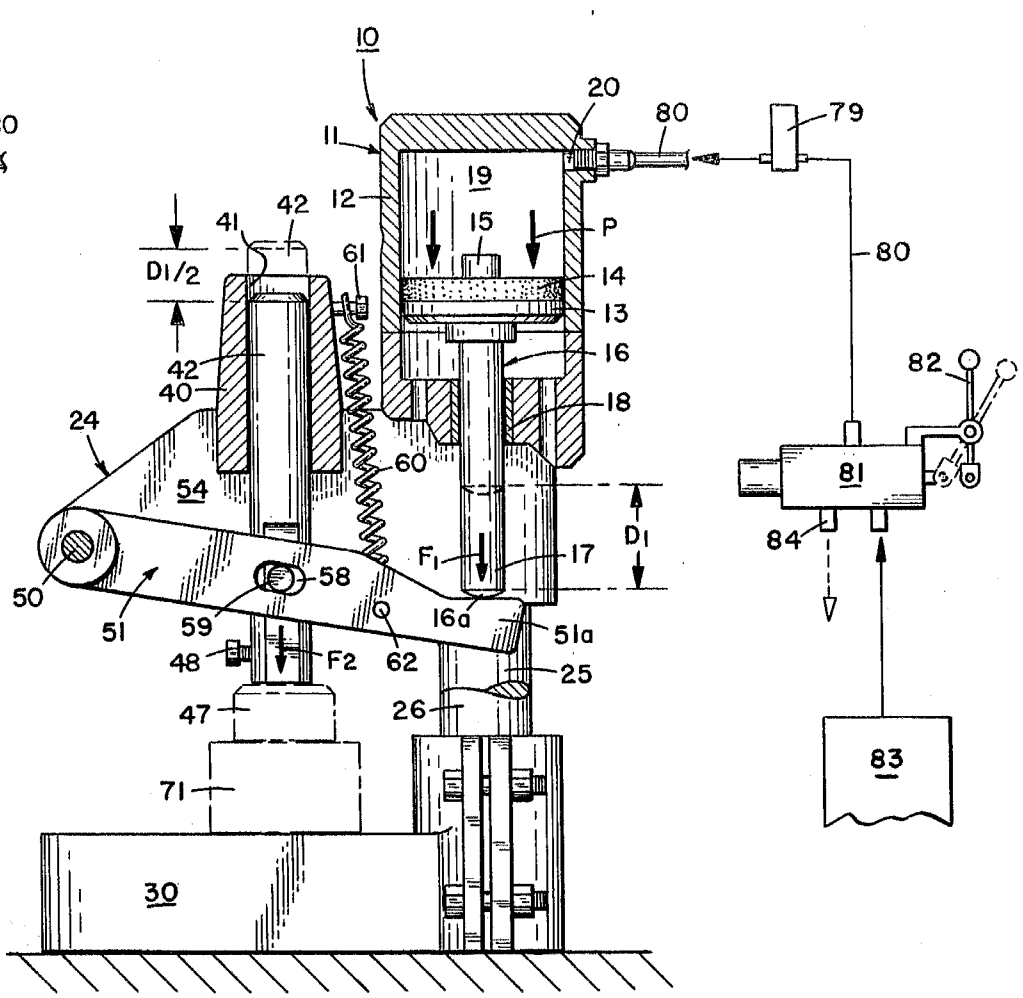
FIG. 4 is a view similar to FIG. 3 with the piston rod in its fully extended position.

The fluid-operated press is generally designated as 10 and preferably comprises an air-operated ram 11 having a cylinder 12, a piston 13 with a cup type seal 14 made of leather or other suitable such material. The piston and seal are mounted near the upper end 15 of a downwardly-extending piston rod, generally designated as 16. The bottom free end 17 of the piston rod is slidably mounted in a bushing 18. High pressure air is admitted into and removed from pressure chamber 19 above the piston 13 through an air inlet/outlet 20. Air can exhaust from the cylinder 12 through a pair of vent holes 21.

Ram 11 is mounted on or made integral part of a mount support 24 which is slidably and adjustably mounted on a column structure having a pair of spaced-apart, parallel, solid columns 25, 26. The arrangement is such that the longitudinal axis of the piston rod 16 is in the center of and in between the support columns 25, 26, whereby their axes are in a single plane. This is an important advantage which eliminates any twisting tendency which otherwise would exist if the piston rod were displaced from the plane containing the longitudinal axes of the support columns.

A base or work table 30 is clampingly secured to the lower ends of columns 25, 26 by a clamp 31. The base 30 extends laterally of the support columns.

The support 24, in addition to supporting ram 11, also supports a vertical guide sleeve 40 having a bore 41 in which is slidably mounted a chuck rod 42. The upper portion of rod 42 has a circular cross section and the lower portion of rod 42 is provided with a pair of opposite flat faces 43, 44 (FIG. 8) having a transverse hole 45 therebetween. The bottom end of chuck rod 42 defines an axial center bore 46 for receiving therein a tool such as a die 47 (FIG. 3) which is secured by a lock pin 48.

Figure 3:
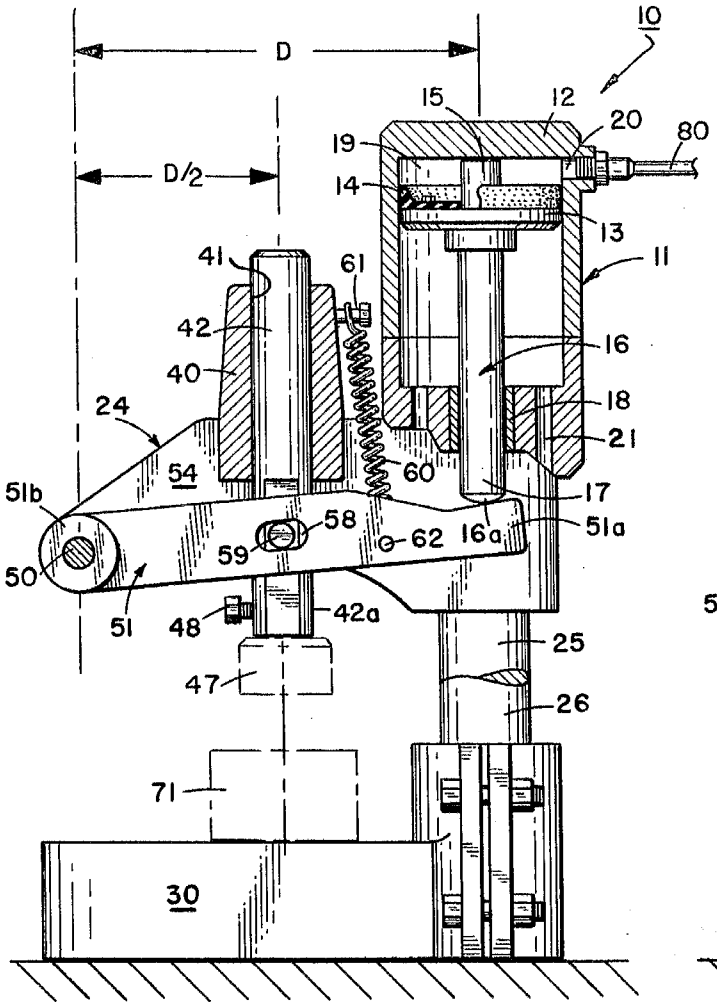
FIG. 3 is a partly sectional view taken on line 3—3 of FIG. 2 with the piston rod in its fully retracted position.

Also mounted near the outer end of the support 24 is a pivot or fulcrum 50 pivotably supporting the distal end of a lever bar 51. The arrangement is such that a spool 52 (FIGS. 5, 6) at the end of bar 51 has a center bore 53 through which extends the pivot 50. The spool 52 is inserted in a rectangular opening 54 within the support 24 (FIG. 2) so that the pivot 50 is supported by a pair of spaced-apart parallel side walls 55, 56 between which opening 54 is defined. The lever bar 51 has a rectangular, longitudinal slot 57 having a width dimension such that the bottom portion **42*a* of the chuck rod 42 can freely extend through slot 57 with the parallel faces 43, 44 of the chuck rod confined between the opposite walls 57*a*, 57*b* defining slot 57. A transverse slot 58 extends between the parallel walls 57*a*, 57*b*. A retainer pin 59 loosely extends through slot 58 (FIG. 3). The lateral dimension of slot 58 is larger than the diameter of pin 59. The chuck rod 42 extends through the slot 57 and is loosely associated with the lever bar 51 by the coupling pin 59**.

Since the ram 11 illustrated in the drawings is single-acting, there is a need for a return spring 60 having one end tied to a bolt 61 on the guide sleeve 40 and the other end tied to a pin 62 extending between walls **57*a*, 57*b* (FIG. 6**).

The distance between the center axes of the piston rod 16 and of the fulcrum pivot 50 is D and to obtain a lever ratio of two, and, therefore, a force multiplication factor of two, the distance between the center axes of the chuck rod 42 and of pivot 50 is D/2. Also, the forward stroke of the push rod 16 is $D_1$ (FIG. 4) and the forward stroke of the chuck rod 42 will be $D_1/2$.

In operation, the work die 47 is inserted into the chuck rod 42 and is secured thereto by the lock pin 48. Pneumatic ram 12 is reciprocated between two extreme positions; in its lowermost position die 47 will press on a work piece 71 placed on the work table 30 underneath the die. The piston rod 16 of ram 11 is not directly connected to the movable die 47 but is adapted to engage the proximate or free end 51*a* of the lever bar 51 thereby to rotate its distal end 51*b* about pivot 50. For this purpose, the outer end of the piston rod is provided with a head 16*a* which is kept in continuous engagement with the adjacent and opposite end 51*a* of the lever bar 51. The return spring 60 associated with lever bar 51 and guide sleeve 40 is sufficiently strong to retain the piston rod in its fully retracted position, as shown in FIG. 3. The return stroke of the piston rod 16 is limited by the engagement between its outer end 15 with the top wall of the cylinder 12.

Inlet/outlet 20 is connected to pipe 80 leading through a lubricator 79 to a manually-operated change-over valve 81 of known form, and displaceable into one or the other of two positions by a control handle 82. Valve 81 connects pipe 80 to a high-pressure air supply reservoir 83 or to a low pressure pipe 84 exhausting to atmosphere.

In the valve position, as shown in FIG. 4, high-pressure air is being admitted into pressure chamber 19 to exert a downward pressure, represented by the arrows P, exerted on the top of piston 13. The pressure produces a force $F_1$ which in one embodiment was 500 kg. The force $F_1$ produced by the piston rod is multiplied by the lever ratio of two, as previously defined, into a force $F_2$, which is 1,000 kg, exerted on the work piece 71.

After completion of the forward stroke, handle 82 is shifted to its dotted position, to allow the pressure chamber 19 to exhaust to atmosphere whereby the piston rod will execute its return stroke under the influence of spring 60. Thus, by the operator's actuation of the control handle 82 the piston rod 16 is projected to cause die 47 to strike work piece 71.

It will be apparent that, while the invention has been described with a single-acting ram, it can equally employ a double-acting ram. Also, the double column support structure is desirable to eliminate the tendency of the support 24 to rotate on or about the columns.

What is claimed is:

1. A fluid-pressure actuated press comprising:

(a) a column structure;

(b) a ram having a piston and an associated piston rod, the free end of the piston rod reciprocating downwardly;

(c) a support adjustably supporting the ram on the column structure;

(d) a lever bar having a proximate free end in engagement with the free end of the piston rod, the distal end of the lever bar being pivoted about a fixed fulcrum carried by the support; and (e) a chuck rod slidably mounted relative to the support along an axis which is substantially parallel to the axis of the piston rod, the chuck rod being pivotably associated with the lever bar at a point intermediate the ends of the lever bar whereby the force of the ram produced on the piston rod is multiplied by the lever and is reproduced on the chuck rod.

2. The press of claim 1 wherein said structure comprises two spaced-apart parallel columns.

3. The press of claim 2 wherein the piston rod axis is in substantially the same plane as the axes of the columns.

* * * * *